US006108814A

United States Patent [19]

Tollini

[11] Patent Number: 6,108,814

[45] Date of Patent: Aug. 29, 2000

[54] FASTENER FOR SHIN GUARD

[76] Inventor: Michael D. Tollini, 9193 Beech Meadow Ct., Clarence Center, N.Y. 14032

[21] Appl. No.: 08/906,410

[22] Filed: Aug. 5, 1997

[51] Int. Cl.[7] ..... A41F 19/00

[52] U.S. Cl. ..... 2/22; 2/311; 2/326

[58] Field of Search ..... 2/22, 16, 24, 62, 2/338, 311, 908, 910, 911, 312, 321, 322, 326; 24/306, 442; 128/DIG. 15

[56] References Cited

U.S. PATENT DOCUMENTS

| | | | |
|---|---|---|---|
| 1,622,211 | 3/1927 | Sheehan | 2/22 |
| 2,817,841 | 12/1957 | Bilecki | 2/22 |
| 3,004,519 | 10/1961 | Weissman | 2/321 |
| 3,387,305 | 6/1968 | Shafer | 2/22 |
| 3,735,419 | 5/1973 | Byrd | 2/22 |
| 4,378,009 | 3/1983 | Rowley et al. | 2/24 |
| 4,497,070 | 2/1985 | Cho | 2/22 |
| 4,700,406 | 10/1987 | Meistrell | 2/22 |
| 4,805,606 | 2/1989 | McDavid | 2/22 |
| 4,888,826 | 12/1989 | Parsons, Jr. et al. | 2/22 |
| 5,016,621 | 5/1991 | Bender | 2/22 |
| 5,450,625 | 9/1995 | Hu | 2/16 |
| 5,537,689 | 7/1996 | Dancyger | 2/24 |
| 5,611,080 | 3/1997 | Skottheim | 2/16 |
| 5,628,063 | 5/1997 | Reed | 2/22 |
| 5,711,028 | 1/1998 | Bourque et al. | 2/22 |
| 5,742,945 | 4/1998 | Lindaman | 2/239 |

FOREIGN PATENT DOCUMENTS

| | | |
|---|---|---|
| 15750 | of 1885 | United Kingdom . |
| 757414 | 9/1956 | United Kingdom . |

*Primary Examiner*—John J. Calvert
*Assistant Examiner*—Tejash Patel
*Attorney, Agent, or Firm*—Joseph P. Gastel

[57] ABSTRACT

A fastener for a shin guard mounted on the leg of an athlete including upper and lower bands connected at their ends by diagonal bands, fork bands connecting the outer ends of the upper and lower bands to each other, a band of pile fabric extending outwardly from one of the fork bands, and a band of hook fabric extending outwardly from the other of the fork bands.

10 Claims, 8 Drawing Sheets

A
B
C
D

FASTENER FOR SHIN GUARD

BACKGROUND OF THE INVENTION

The present invention relates to a fastener for holding a shin guard in position on the leg of an athlete such as a hockey player, and any other person who wears a shin guard.

By way of background, in sports such as hockey, shin guards are used to protect the shins of a player. The shin guards are usually mounted directly on the leg underneath a stocking. The shin guards are usually secured in position by means of upper and lower straps. This is usually insufficient to hold the shin guard in position. Accordingly, in the past there were numerous supplementary ways of holding the shin guard in position. One way was by binding the outside of the sock with adhesive tape. However, this was generally inadequate in that if the tape was wound too loosely, the shin guard was not held in position, and if it was wound too tightly, it could cut off circulation. Also in the past, elastic bands were used at the top and bottom of the shin guards. However, these bands, being stretchable, would permit the shin guard to move. Also, prior devices included an elongated sheet of elastic with vertical bands of hook and pile fabric at the edges of the sheet, and these were wound around the leg. However, the sheet would not conform to the leg and thus there was looseness in certain areas. It is with overcoming the foregoing deficiencies of the prior art that the present invention is concerned.

BRIEF SUMMARY OF THE INVENTION

It is accordingly one object of the present invention to provide an improved fastener for a shin guard wherein there are multiple areas of contact longitudinally of the shin guard both in front and on the sides and on the rear of the leg.

Another object of the present invention is to provide a fastener for a shin guard which provides multiple areas of contact while requiring only a single area for fastening the fastener.

A further object of the present invention is to provide an improved fastener for a shin guard wherein attachment members at the outer ends of the fastener, when attached to each other, are acted on by forces from many different directions which tends to prevent the fasteners from unfastening. Other objects and attendant advantages of the present invention will readily be perceived hereafter.

The present invention relates to a fastener for securing a shin guard on a leg comprising an upper band structure, a lower band structure underlying and spaced from said upper band structure, first and second opposite ends on said upper band structure, third and fourth opposite ends on said lower band structure, a first band joining said first and third ends, a second band joining said second and fourth ends, and attachment members on said first and second bands.

The various aspects of the present invention will be more fully understood when the following portions of the specification are read in conjunction with the accompanying drawings wherein:

DETAILED DESCRIPTION OF THE INVENTION

Figures 1, 2, 3, 4:
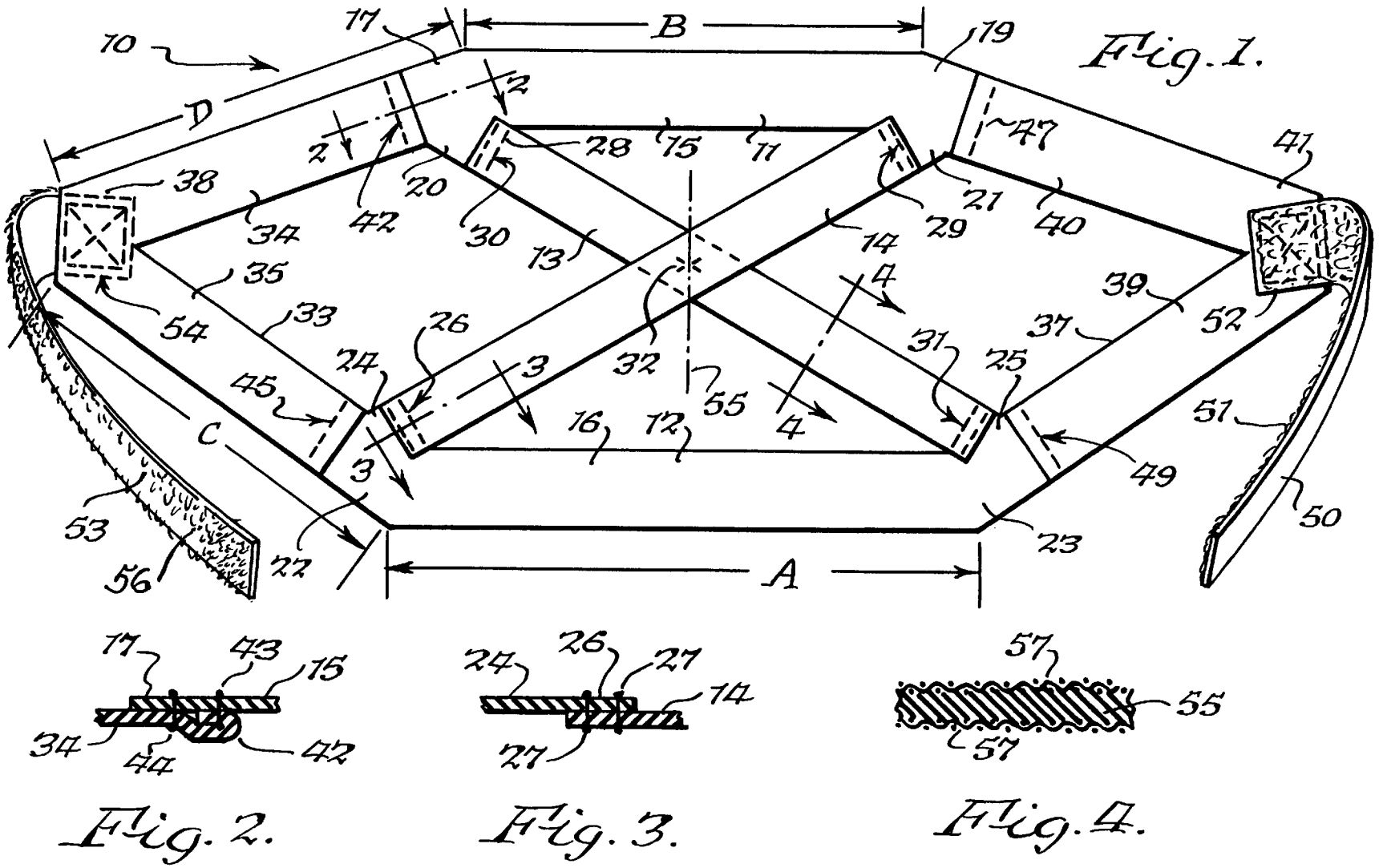
FIG. 1 is a plan view of the fastener for securing a shin guard on a leg, with the view showing the outside surface thereof.
FIG. 2 is a fragmentary cross sectional view taken substantially along line 2—2 of FIG. 1 and showing the type of seam which is used at this junction.
FIG. 3 is a fragmentary cross sectional view taken substantially along line 3—3 of FIG. 1 and showing the lap type of seam used at this junction.
FIG. 4 is a fragmentary cross sectional view taken substantially along line 4—4 of FIG. 1 and showing the type of material which is used for all of the parts except for the attachment members on the outer end portions of the fastener.

The central portion of shin guard fastener 10 of the present invention includes an upper band structure 11, a lower band structure 12, and diagonal bands 13 and 14 effectively extending between upper band structure 11 and lower band structure 12. Upper band structure 11 includes a horizontal band 15 having downwardly sloping ends 17 and 19 which are mirror image counterparts. Downwardly sloping ends 17 and 19 include tab portions 20 and 21, respectively. Lower band structure 12 includes a horizontal band 16 and inclined ends 22 and 23 which are mirror image counterparts. Inclined end 22 includes a tab 24 and inclined end 23 includes a tab 25. The ends of diagonal band 14 are secured to tabs 21 and 24 by means of sewn lap joints 26 and 29. Lap joint 26 includes two rows of stitching 27, and lap joint 29 is the mirror image of lap joint 26. The outer ends of diagonal band 13 are sewn to tabs 20 and 25 by means of sewn lap joints 30 and 31, respectively. Lap joint 30 includes two rows of stitching 28, and lap joint 31 is essentially the mirror image of lap joint 30. Diagonal bands 13 and 14 are preferably threadably tacked to each other at their crossover area 32, but they need not be tacked. Also bands 13 and 14 can be sewn to each other in any suitable manner at their crossover area 32.

The upper band structure 11 of shin guard fastener 10 includes bands 34 and 40, and the lower band structure 12 includes bands 35 and 39. Bands 34 and 35 comprise a forked member 33 having a vertex 38. Bands 39 and 40 comprise a forked member having a vertex 41. Thus, the left end 17 of upper band 11 and the left end 22 of lower band 12 are connected to each other by a forked connecting member 33 having band portions 34 and 35 which are formed integrally at their vertex 38. The right end 19 of upper band 11 and the right end 23 of lower band 12 are connected to each other by forked connecting member 37 consisting of bands 39 and 40 which are integrally joined at vertex 41.

As can be seen from the above description, the upper band structure 11 and the lower band structure 12 are multiple band structures because they consist of a plurality of bands. The diagonal bands 13 and 14 are also a multiple band structure in the form of an X.

FIG. 2 shows the joint 42, which is known as a sew seam reverse and topstitch joint, wherein the end 17 of band 15 is initially stitched to the end of band 34 by a row of stitching 43 when band 34 is laid on tab 17 and thereafter band 34 is turned 180° and tab 17 is stitched to band 34 by a row of stitching 44. Seam 45 is also a sew seam reverse and topstitch seam, and it is the mirror image of seam 42. Seam 47 is the mirror image of seam 42 and seam 49 is the mirror image of seam 45. A band 50 is stitched by means of a lap joint 52 to vertex 41 of member 37. Band 50 has an attachment member in the form of a pile surface 51 thereon. A band 53 having an attachment member in the form of a hook surface 56 is attached to vertex 38 at a lap joint by stitching 54. Bands 50 and 53 preferably extend upwardly from the horizontal at approximate angles of 10°, but they need not extend upwardly at an angle.

The material from which all parts except attachment members 51 and 53 are made is stretchable and resilient, and it consists essentially of elastic neoprene foam core 55 bounded by knit fabric sides 57, and it is a commercial product of the Griswold Rubber Co. Thus, all parts except attachment members 50 and 53 are stretchable and resilient so as to conform to a leg about which they are wound.

By way of example and not of limitation a model has been made up having the following dimensions. Dimension A is 12 inches. Dimension B is 9 inches. Dimension C is 7½ inches, and dimension D is also 7½ inches. The fastener 10 is symmetrical about centerline 55.

FIGS. 5–9 are schematic representations of the steps used in mounting the shin guard fastener 10 onto a leg having a shin guard thereon, and FIGS. 9–12 show the fastener in fully mounted position. In these series of figures, the fastener 10 is schematically shown with only major portions thereof having numerals thereon.

Figure 5:
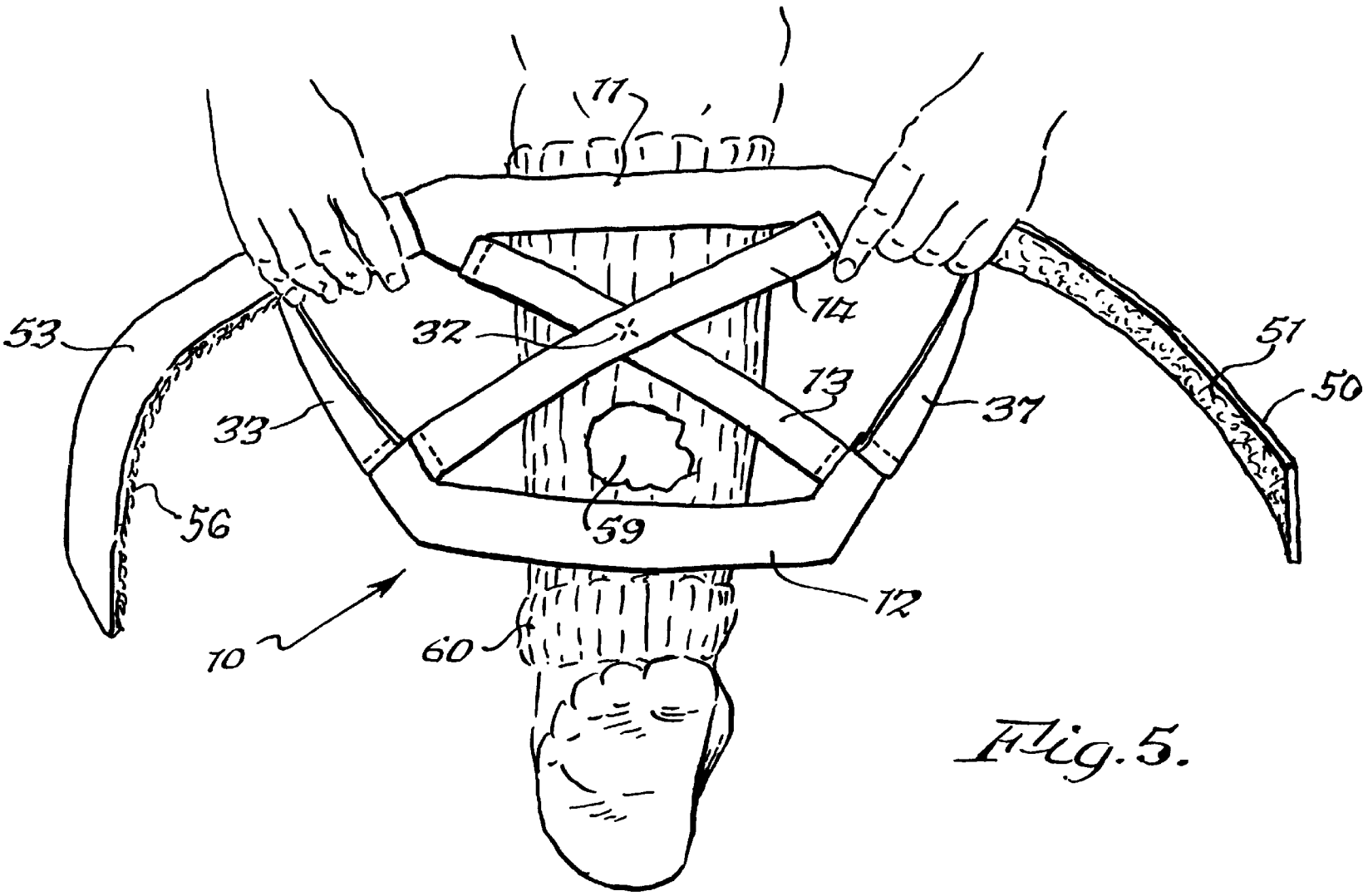
FIG. 5 is a fragmentary front elevational view showing the first step in mounting the fastener on a leg having a shin guard thereon.

In FIG. 5 the fastener 10 is shown in the initial position which it occupies with its upper band 11 against the upper portion of the shin and the lower band 12 against the lower portion of the shin. More specifically, the fastener 10 is shown as being used against the leg of a hockey player which mounts a shin guard 59 underneath a stocking 60. It will be appreciated that the shin guard 59 can be of any suitable type which is used in hockey, or if the fastener 10 is to be used with shin guards of other types, it can be visualized that shin guard 59 is the type used with such other sports.

Figure 6:
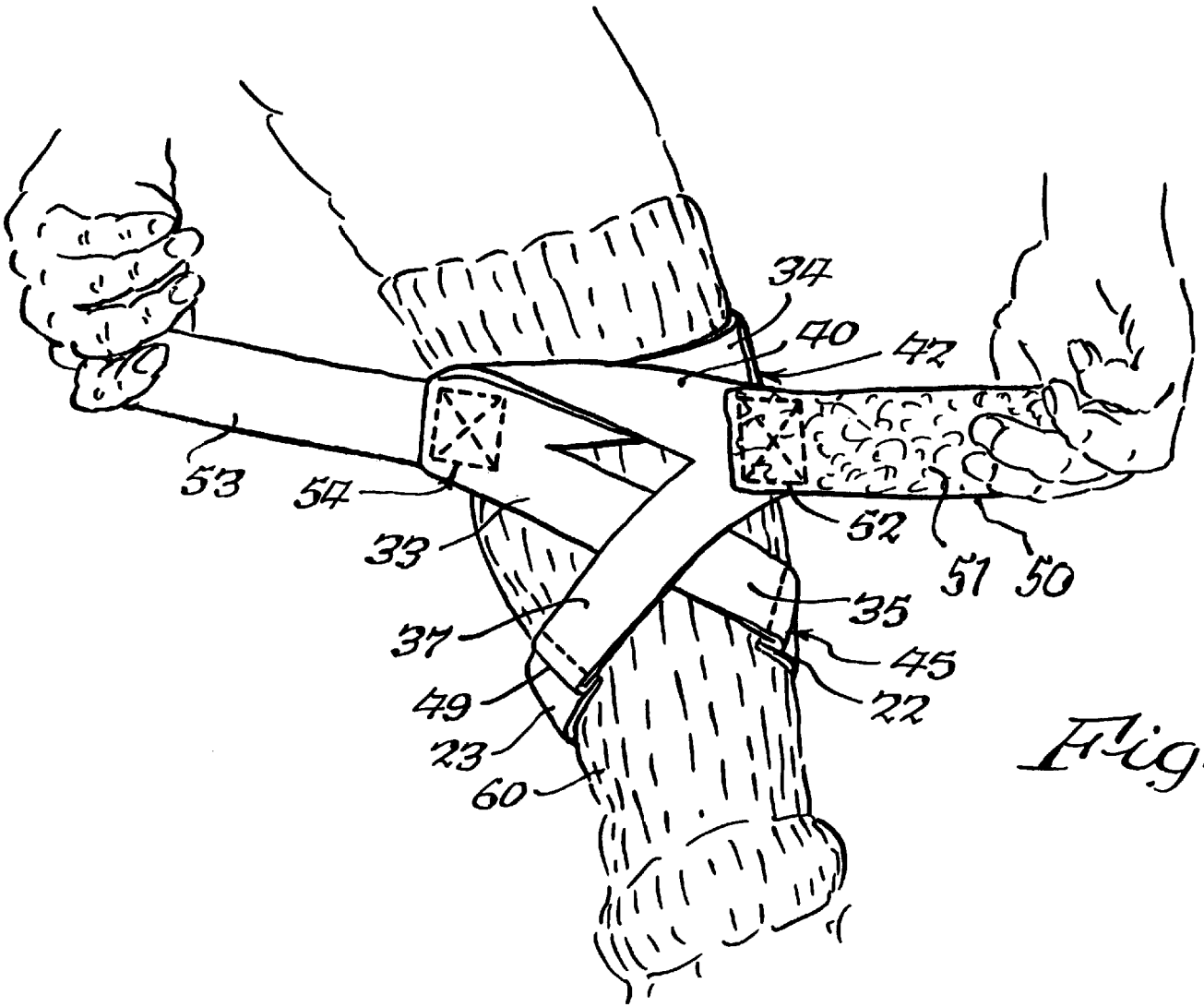
FIG. 6 is a rear elevational view of a leg with the fastener wrapped around the rear thereof during an initial stage of mounting the fastener on the leg.
Figure 7:
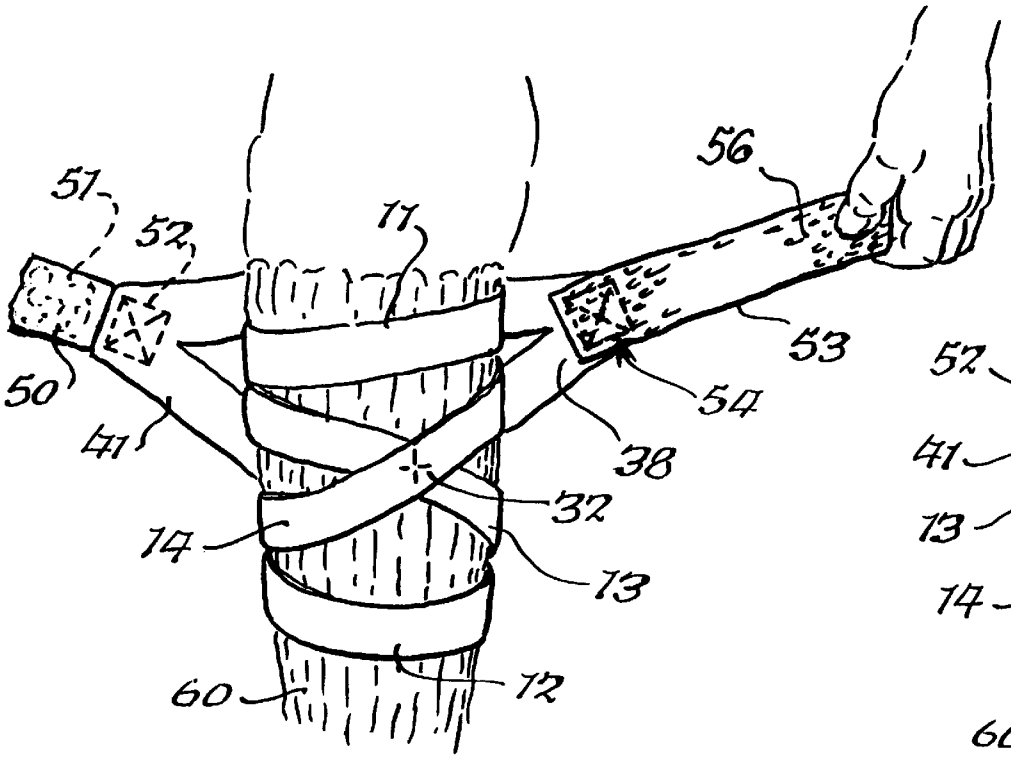
FIG. 7 is a front elevational view corresponding to the rear elevational view of FIG. 6.

In FIG. 6 a rear view of the leg is shown with the connecting member 33 threaded through the connecting member 37. At this time, the central portion of the shin guard 10 is pulled tightly against the front and sides of the leg. In FIG. 7 shin guard fastener 10 is shown on the front of the leg, and it corresponds to the position of the fastener 10 in FIG. 6.

Figure 8:
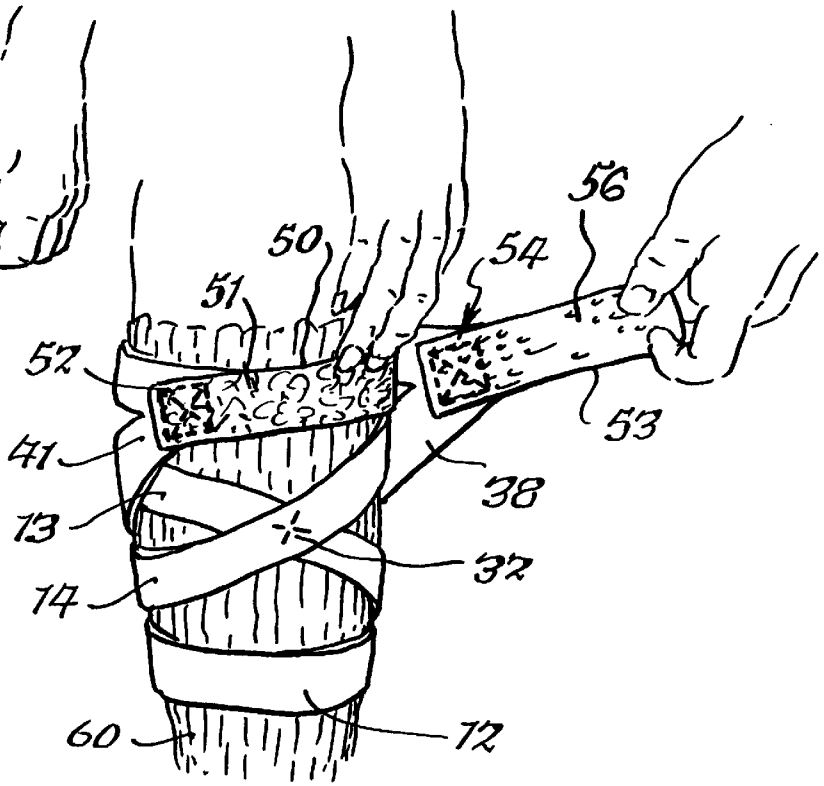
FIG. 8 is a front elevational view illustrating the next step of mounting the fastener on the leg by laying down the attachment member with pile thereon onto the shin.
Figure 9:
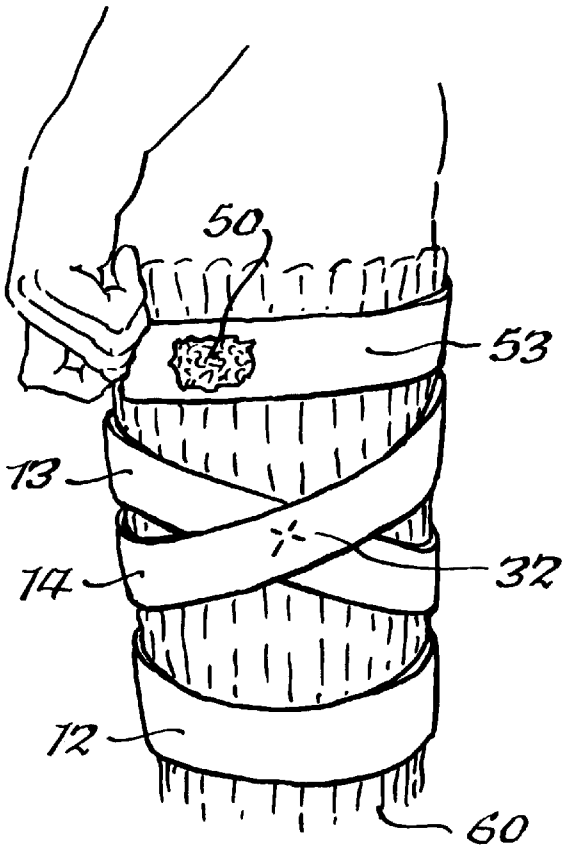
FIG. 9 is a front elevational view showing the attachment member with loops thereon being fastened to the attachment member having pile thereon.

In FIG. 8 the next position is shown wherein the attachment member 50 is laid against the shin with the pile 51 facing away from the shin while the connecting member is held in the position shown. In FIG. 9 the fastening member 53 is fastened to fastening member 50 by engaging the hooks on member 53 with the pile on member 50.

Figure 10:
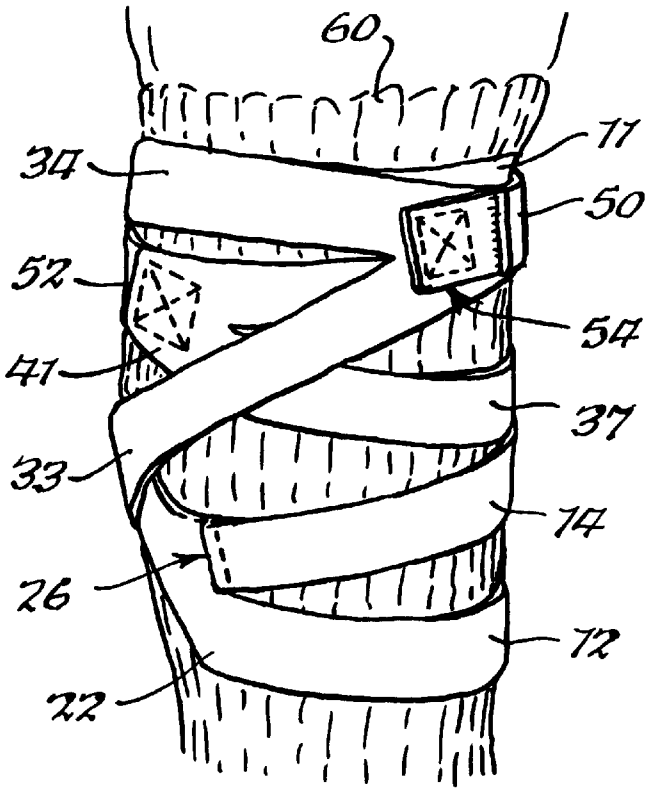
FIG. 10 is a side elevational view of the fully mounted fastener on the right side of the leg.
Figure 12:
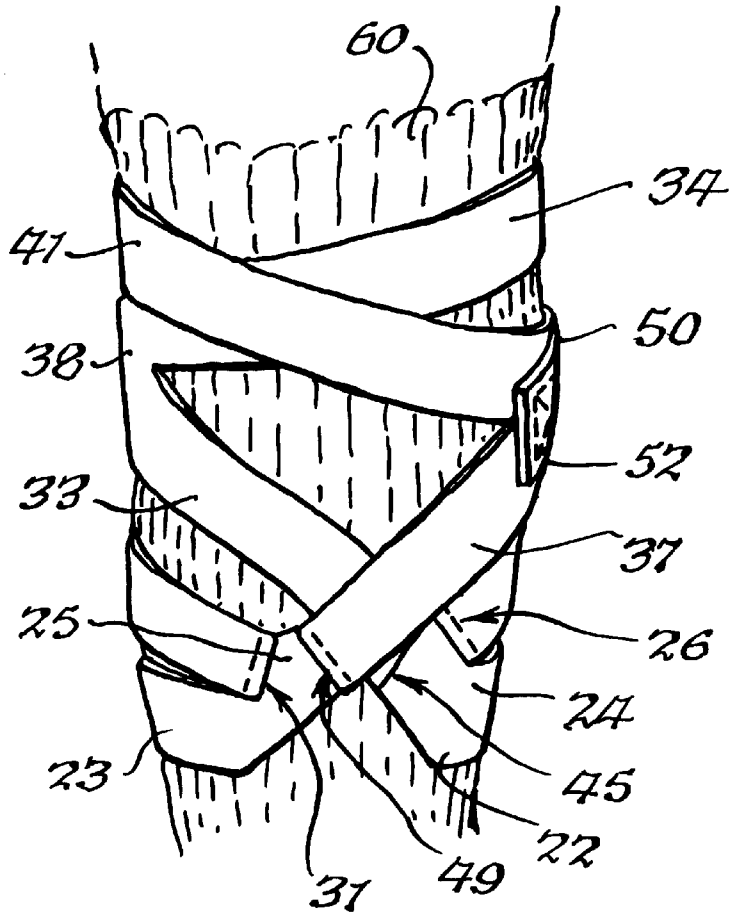
FIG. 12 is a rear elevational view showing the fastener in fully mounted position on the leg.
Figure 11:
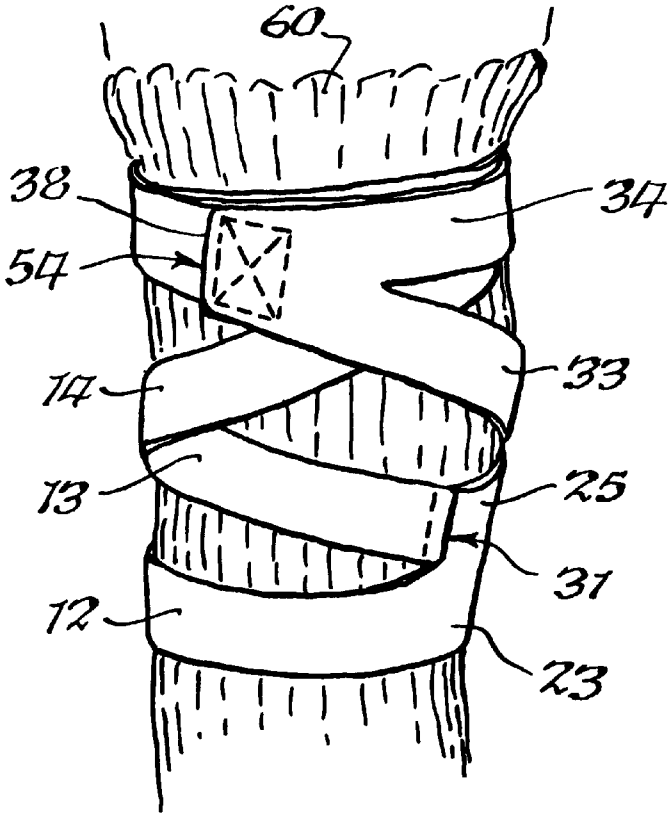
FIG. 11 is a fragmentary side elevational view of the fully mounted fastener on the left side of the leg.

In FIGS. 10, 11 and 12, the positions of the various parts of the fastener 10 are shown when the fastener 10 is in fully installed position on the leg of a person wearing a shin guard.

Figure 13:
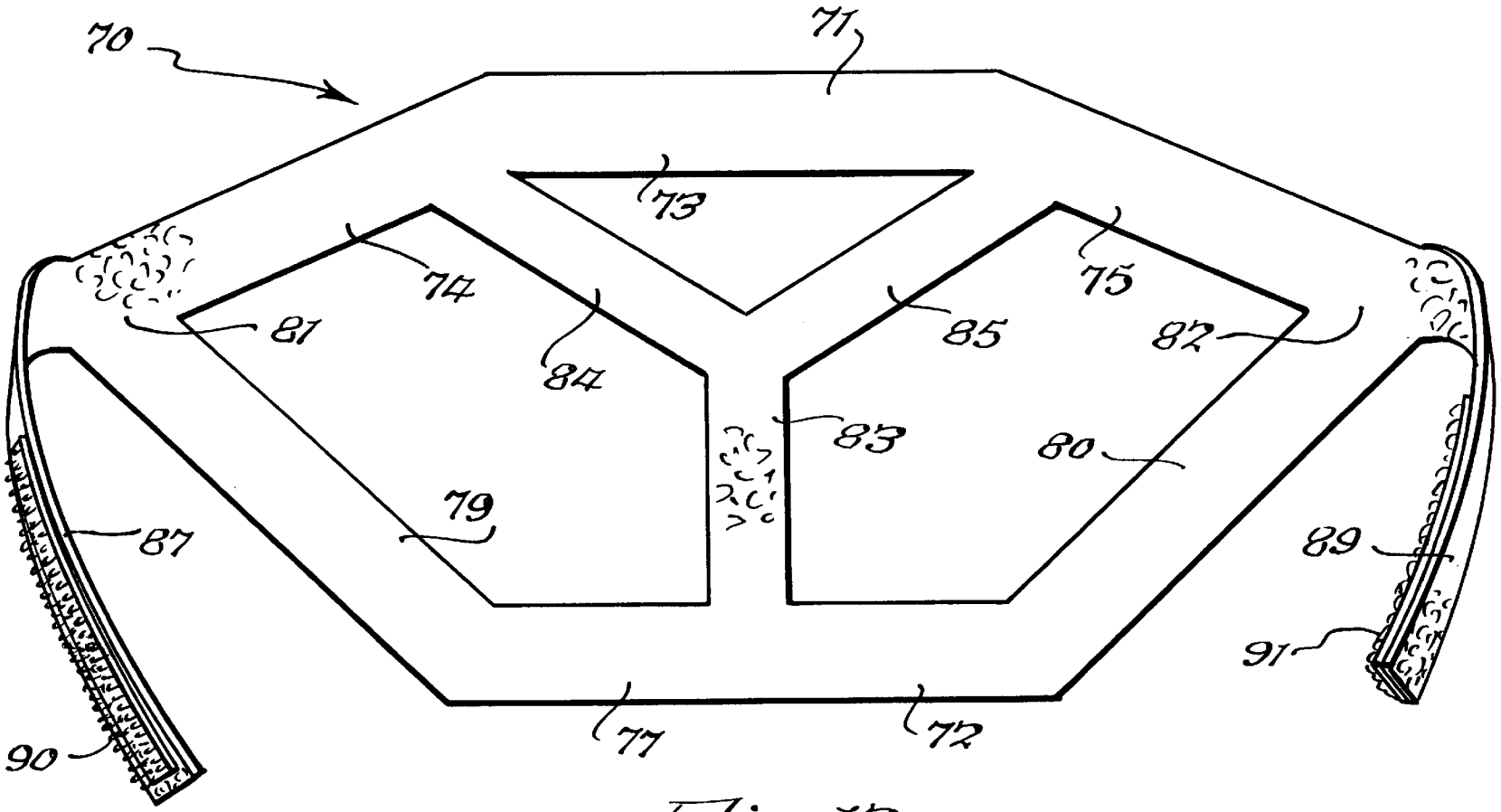
FIG. 13 is a plan view of another embodiment of the present invention.

In FIG. 13 a shin guard fastener 70 is shown which has a different configuration than the shin guard fastener of FIG. 1. Fastener 70 includes upper band structure 71 and lower band structure 72. Band structure 71 includes an upper band 73 and downwardly extending bands 74 and 75. Lower band structure 72 includes lower band 77 and upwardly extending bands 79 and 80. Bands 73 and 77 are substantially parallel to each other, and lower band 77 is longer than upper band 73. Bands 74 and 79 are joined at vertex 81. Bands 75 and 80 are joined at vertex 82. Band 83 extends upwardly from the central portion of band 77, and bands 84 and 85 extend upwardly and outwardly from the end of band 83 and are connected to the upper band structure 71 proximate the outer ends of upper band 73. Bands 83, 84 and 85 are in a configuration of a Y. Bands 87 and 89 extend outwardly from vertices 81 and 82, respectively. Hook fabric 90 is suitably attached to band 87, and pile fabric 91 is suitably attached to band 89. The various bands of shin guard fastener 70 are fabricated of the same material described above relative to the embodiment of FIG. 1. Also while FIG. 13 does not show how the various bands are attached to each other, it will be appreciated that shin guard fastener 70 may be fabricated by cutting from a single piece of material, or the various bands can be sewn to each other in any suitable manner including the manner discussed above relative to the embodiment of FIG. 1. Alternately, fastener 70 can be made of a combination of bands which are integral with each other and bands which are sewn to each other. The shin guard fastener 70 of FIG. 13 is mounted on the leg of an athlete in the same manner as described above relative to the embodiment of FIG. 1.

The upper band structure 71 and the lower band structure 72 are multiple band structures because they each consist of a plurality of bands. Additionally, the Y-band structure consisting of bands 83, 84 and 85 is also a multiple band structure because it consists of a plurality of bands.

Figure 14:
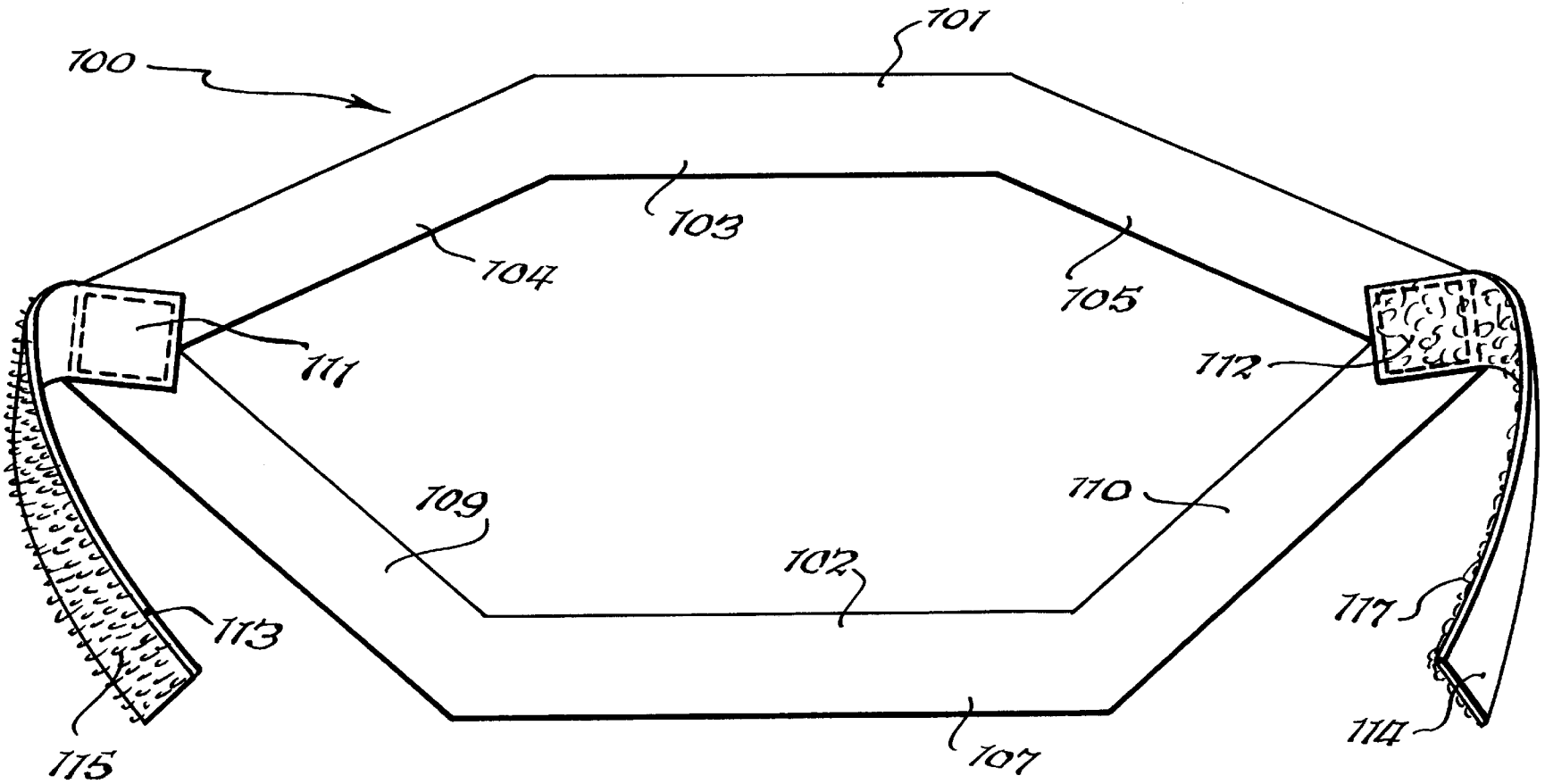
FIG. 14 is a plan view of still another embodiment of the present invention.

In FIG. 14 a shin guard fastener 100 is shown which has a still different configuration. It includes an upper band structure 101 and a lower band structure 102. The upper band structure 101 includes a band 103, and bands 104 and 105 extend downwardly from upper band 103. The lower band structure 102 includes a lower band 107, and bands 109 and 110 extend upwardly from band 107. Bands 103 and 107 are substantially parallel to each other, and band 107 is longer than band 103. Bands 104 and 109 are joined at vertex 111, and bands 105 and 110 are joined at vertex 112. Band 113 is sewn relative to bands 104 and 109 at vertex 111, and band 114 is sewn relative to bands 105 and 110 at vertex 112. An attachment member in the form of hook fabric 115 extends outwardly from the face of band 113, and an attachment member in the form of pile fabric 117 extends outwardly from the face of band 114. The body of shin guard fastener 100 consisting of the various bands may be cut from a single piece of material, or each of the individual bands may be sewn at their junctures in any suitable manner including those disclosed above relative to FIG. 1, or there can be a combination of integral connections and sewn joints among the various bands. The shin guard fastener is fabricated from the same material set forth above relative to FIG. 1. Also, the shin guard fastener 100 is mounted on the leg of an athlete in substantially the same manner as discussed above relative to the embodiment of FIG. 1.

The upper band structure 101 and the lower band structure 102 are multiple band structures because they consist of a plurality of bands. In the embodiment 100 of FIG. 14 there is no multiple band structure between the upper band structure 101 and the lower band structure 102.

While hook and pile fabrics are the preferred way of attaching the shin guard fasteners to the leg, it will be appreciated that other types of fasteners such as clips, buckles, etc. may be used. Also, while the preferred has been made of bands sews together, it will be appreciated that the shin guard fastener may be made out of a single piece of material.

While the above description has specifically shown multiple band structures in the form of an X and in the form of a Y between the upper and lower band structures, it will be appreciated that the band structures between the upper band structure and the lower band structure may be in any desired configuration including any combination of one or more horizontal bands, one or more vertical bands, and one or more bands which are inclined to the upper and lower band structures.

While preferred embodiments of the present invention have been disclosed, it will be appreciated that it is not limited thereto but may be otherwise embodied within the scope of the following claims.

What is claimed is:

1. A fastener for securing a shin guard on a leg comprising an upper band structure, a lower band structure including a portion spaced from said upper band structure, first and second opposite ends on said upper band structure, third and fourth opposite ends on said lower band structure, a first band joined to said first and third ends, a second band joined to said second and fourth ends, attachment members on said first and second bands, said upper and lower band structures each comprising a plurality of bands, said plurality of bands of said upper band structure including an upper band having fifth and sixth opposite ends, third and fourth bands extending outwardly from said fifth and sixth opposite ends of said upper band, said lower band structure including a lower band having seventh and eighth ends and fifth and sixth bands extending outwardly from said seventh and eighth ends of said lower band, said third band having an outer end which is attached to an outer end of said fifth band at said first end which is a vertex, and said fourth band having an outer end which is attached to the outer end of said sixth band at said second end which is a vertex.

2. A fastener as set forth in claim 1, wherein said upper and lower bands are substantially parallel to each other.

3. A fastener as set forth in claim 2, including a first diagonal band extending substantially between said fifth and eighth ends, and a second diagonal band extending between said sixth and seventh ends.

4. A fastener as set forth in claim 1, including a seventh band extending upwardly toward said upper band from a central portion of said lower band, an upper end on said seventh band, and eighth and ninth bands diverging outwardly from said upper end of said seventh band, and ninth and tenth ends on said eighth and ninth bands, respectively, attached proximate said fifth and sixth opposite ends of said upper band.

5. A fastener as set forth in claim 4 wherein said upper and lower band structures include upper and lower bands which are substantially parallel to each other.

6. fastener for securing a shin guard on a leg comprising an upper band structure, a lower band structure including a portion spaced from said upper band structure, first and second opposite ends on said upper band structure, third and fourth opposite ends on said lower band structure, a first band joined to said first and third ends, a second band joined to said second and fourth ends, attachment members on said first and second bands, and first and second diagonal bands extending between said upper and lower band structures.

7. A fastener as set forth in claim 6, wherein said first and second diagonal bands have central portions secured to each other.

8. A fastener as set forth in claim 7, wherein said upper and lower band structures each comprise a plurality of bands.

9. A fastener for securing a shin guard on a leg comprising an upper band structure, a lower band structure including a portion spaced from said upper band structure, first and second opposite ends on said upper band structure, third and fourth opposite ends on said lower band structure, a first band joined to said first and third ends, a second band joined to said second and fourth ends, attachment members on said first and second bands, and a multiple band structure extending between said upper and lower band structures, said multiple band structure comprising a plurality of bands in the shape of a Y.

10. A fastener for securing a shin guard on a leg comprising an upper band structure, a lower band structure including a portion spaced from said upper band structure, first and second opposite ends on said upper band structure, third and fourth opposite ends on said lower band structure, a first band joined to said first and third ends, a second band joined to said second and fourth ends, attachment members on said first and second bands, and a multiple band structure extending between said upper and lower band structures, said multiple band structure comprising a plurality of bands in the form of an X.

* * * * *